United States Patent [19]

Faulkner et al.

[11] 4,456,852

[45] Jun. 26, 1984

[54] MESH STRUCTURE FOR A PHOTOMULTIPLIER TUBE

[75] Inventors: Richard D. Faulkner, Lancaster; Dale V. Henry, Willow Street, both of Pa.

[73] Assignee: RCA Corporation, New York, N.Y.

[21] Appl. No.: 343,179

[22] Filed: Jan. 27, 1982

[51] Int. Cl.[3] ..... H01J 1/46; H01J 1/52; H01J 17/04; H01J 17/12; H01J 19/38; H01J 19/40; H01J 21/10

[52] U.S. Cl. ..... 313/348; 313/532; 313/541; 29/18

[58] Field of Search ..... 313/104, 105 R, 348, 313/532, 533, 534, 535, 536, 537, 541, 542, 544; 29/25.14, 25.18

[56] References Cited

U.S. PATENT DOCUMENTS

| | | | |
|---|---|---|---|
| 3,130,487 | 4/1964 | Mears | 29/424 |
| 3,152,384 | 10/1964 | Toohig et al. | 29/25.18 |
| 3,200,469 | 8/1965 | Law | 29/25.18 |
| 3,344,495 | 10/1967 | Drees et al. | 29/25.14 |
| 3,352,729 | 11/1967 | Kling et al. | 156/3 |
| 4,060,747 | 11/1977 | Faulkner | 313/95 |

FOREIGN PATENT DOCUMENTS

| | | | |
|---|---|---|---|
| 798953 | 7/1958 | United Kingdom | 343/912 |

*Primary Examiner*—David K. Moore
*Assistant Examiner*—Robert E. Wise
*Attorney, Agent, or Firm*—Eugene M. Whitacre; Dennis H. Irlbeck; Vincent J. Coughlin, Jr.

[57] ABSTRACT

A planar mesh structure that facilitates forming into a non-planar mesh structure comprises a peripheral support ring lying in a plane with a plurality of first members and a plurality of second members lying in the plane. The first members comprise substantially concentric, spaced-apart mesh rings of progressively decreasing diameter disposed within the peripheral support ring. The plurality of second members extend generally inwardly from the peripheral support ring and terminate at the innermost of the first members. The second members intersect the first members disposed between the peripheral support ring and the innermost first member to form, with the intersected first members, a plurality of apertures. In one embodiment, the second members are generally arcuately shaped and lie in a first plane with the support ring and the first members. The arcuate shape permits the second members to be formed in a second plane substantially orthogonal to the first plane without significantly stretching the second members. In an alternative embodiment, the second members have a generally undulatory shape lying in the first plane with the support ring and the first members. The generally undulatory shape provides forming relief which permits the second members to be formed into a second plane substantially orthogonal to the first plane without significantly stretching the second members.

4 Claims, 5 Drawing Figures

52
62
62
60
56
54r
58
54a
24
62
62
62

76
84
86
88
72
80
50
78
56
74
82

10
12
14
22
26
32
20
28
28
30
16
24
18
19
34
36

MESH STRUCTURE FOR A PHOTOMULTIPLIER TUBE

BACKGROUND OF THE INVENTION

The present invention relates to a mesh electrode structure for an electron discharge device and more particularly to a planar mesh electrode structure that facilitates forming into a non-planar mesh electrode structure for a photomultiplier tube.

An electron multiplier is a device utilizing secondary electron emission to amplify or multiply the electron current from a primary electron source, such as a photocathode or a thermionic cathode. The usual electron multiplier comprises a series or chain of secondary emitting elements, called dynodes, interposed between a primary electron source and an output collector or anode. The electrodes are constructed and arranged to form an electron optical system for directing primary electrons from the primary source onto the first dynode releasing therefrom several secondary electrons or "secondaries" for each primary electron. These secondaries are directed by the electron optical system onto the next dynode where each produces more secondaries. This process is repeated at each succeeding dynode or "stage" of the multiplier, thus producing a greatly multiplied electronic current from the final dynode to the collector. The number of dynodes or stages may be from one to twenty or more depending on the amount of amplification needed. Each succeeding dynode in the chain is maintained at a potential substantially higher, e.g., 100 volts, than the preceding dynode, to accelerate the secondaries from dynode to dynode. The dynodes are preferably shaped to direct and focus the electrons emitted therefrom to the next dynode.

Electron multipliers are particularly useful for amplifying electron currents produced by weak signals, such as light or nuclear radiation. When used for detecting and/or counting rapidly recurrent signals such as nuclear particles, it is necessary that the multiplier have sufficient speed and a resolving time low enough to distinguish between successive signals or particles.

The speed of a multiplier can be increased by reducing the overall transit time of primary and secondary electrons between the primary electron source and the collector. The resolving time of a multiplier is limited by the transit time spread of electrons through the multiplier chain, that is, the difference between the transit times of the fastest and slowest electrons. This transit time spread is primarily due to differences in the trajectories taken by various electrons through the multiplier and differences in the initial velocities of secondary electrons. A structure for improving the electron transit time through the multiplier is disclosed in copending U.S. Pat. No. 4,431,943 filed on Oct. 14, 1981 by Faulkner et al., assigned to the same assignee of the present application and incorporated herein for disclosure purposes.

In photomultiplier tubes, the speed or transit time of the tube is a function of both the photocathode transit time difference and the transit time of the electron multiplier. The photocathode transit time difference, defined as the time difference between peak current outputs for simultaneous small-spot illumination of different parts of the photocathode, is longer for edge illumination than for center illumination because of the longer edge trajectories for photoelectrons and the weaker electric field near the edge of the photocathode. In a planar photocathode, the center-to-edge transit time difference may be as much as 10 nanoseconds; whereas for spherical-section photocathodes, such as that shown in FIG. 1, the transit time response is more uniform because the electron paths are nearly equal in length.

The photocathode transit time difference is ultimately limited by the initial velocity distribution and angular distribution of the photoelectrons. These distributions cause time broadening of the electron packet during its flight from the photocathode to the first dynode. The broadening effect can be minimized by increasing the strength of the electric field at the surface of the photocathode. One way of increasing the electric field at the surface of the photocathode is to locate a mesh electrode a small distance from the cathode; however, in tubes having spherical-section photocathodes, it is difficult to form a spherical-section mesh. One method of forming such a mesh is described in U.S. Pat. No. 4,060,747 issued to R. D. Faulkner on Nov. 29, 1977 and incorporated by reference herein for the purpose of disclosure. The Faulkner patent discloses a domed mesh electrode having nonuniform apertures formed by stretching a planar metal member to achieve the non-planar shape. Frequently, the mesh wires break during stretching and the torn mesh must be disgarded. Thus, it is desirable to be able to form a non-planar mesh electrode while eliminating or minimizing the stretching experienced by the mesh wires.

SUMMARY OF THE INVENTION

A planar mesh structure that facilitates forming into a non-planar mesh structure comprises a peripheral support ring lying in a plane with a plurality of first members and a plurality of second members lying in the plane. The first members comprise substantially concentric, spaced apart mesh rings of progressively decreasing diameter disposed within the peripheral support ring. The plurality of second members extend generally inwardly from the peripheral support ring and terminate at the innermost of the first members. The second members intersect the first members disposed between the peripheral support ring and the innermost first member to form, with the intersected first members, a plurality of apertures. The second members include relief means whereby the planar mesh structure may be formed into a non-planar mesh structure without significantly stretching the second members.

DESCRIPTION OF THE PREFERRED EMBODIMENT

Figure 1:
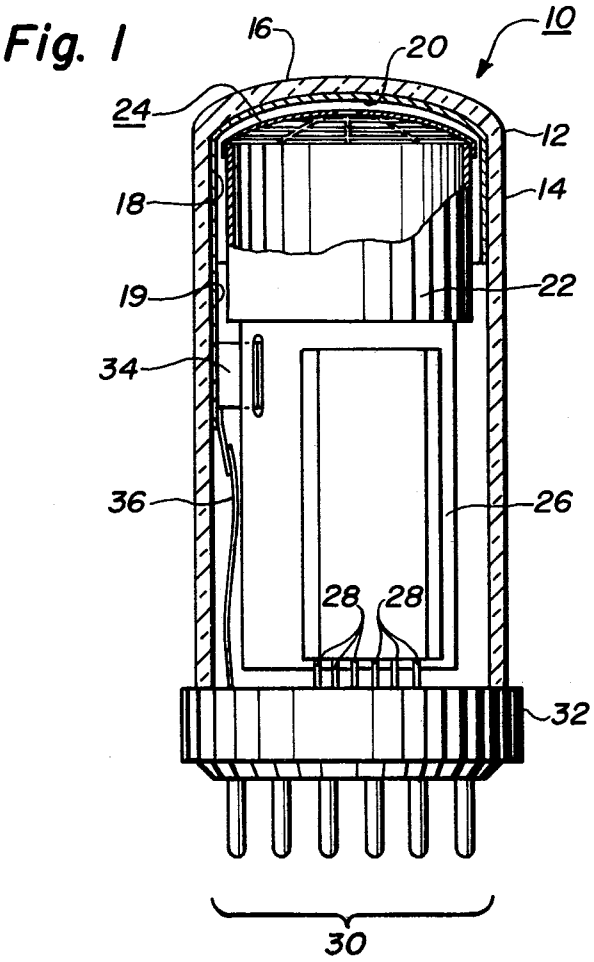
FIG. 1 is a partially cut-away side view of a photomultiplier tube in which an embodiment of the present invention is incorporated.

Referring to FIG. 1, there is shown a photomultiplier tube 10 comprising an evacuated envelope 12 having a generally cylindrical sidewall 14 and a faceplate 16. An aluminized coating 18 is disposed on an interior surface portion of the sidewall 14 adjacent to the faceplate 16. The coating 18 also includes a projection 19 that extends longitudinally along a portion of the sidewall 14. Within the tube 10 is a photoemissive photocathode 20 on the interior surface of the faceplate 16. The photocathode 20 is in contact with the coating 18 on the sidewall 14. The photocathode 20 may be potassium-cesium-antimonide, for example, or any one of a number of photoemissive materials well known in the art. The photocathode 20 provides photoelectrons in response to radiation incident thereon.

The tube is provided with a cup-shaped field-forming electrode 22, which is spaced from the photocathode 20 and which terminates in a substantially flat base portion having an aperture (not shown) therein. A non-planar mesh electrode structure 24 is attached to the open end of the cup-shaped field-forming electrode 22. The mesh electrode 24 provides a substantially uniform electric field adjacent to the photocathode 20 to substantially equalize the center-to-edge transit time difference for photoelectrons from the photocathode 20. The field-forming electrode 22 is supported by a pair of support insulators 26, (only one of which is shown). The insulators 26 may comprise a material such as ceramic that has high mechanical strength.

An electron multiplier (not shown), comprising a primary dynode, a plurality of secondary dynodes and an anode, is disposed between the support insulators 26. A plurality of conductive lead members 28 (only some of which are shown) extend between the electrode 22, the dynodes, the anode, and a plurality of terminals 30 in a base 32 attached to the tube 10.

Electrical connection to the photocathode 20 is provided by a contact member 34. The contact member 34 contacts and conforms to a large area of the projection 19 which is integral with the conductive coating 18. A cathode lead 36 is attached at one end to the contact member 34 and at the other end to one of the terminals 30 in the base 32. Electrical potentials are applied to the various tube elements from an external source (not shown) through the terminals 30.

Figure 4:
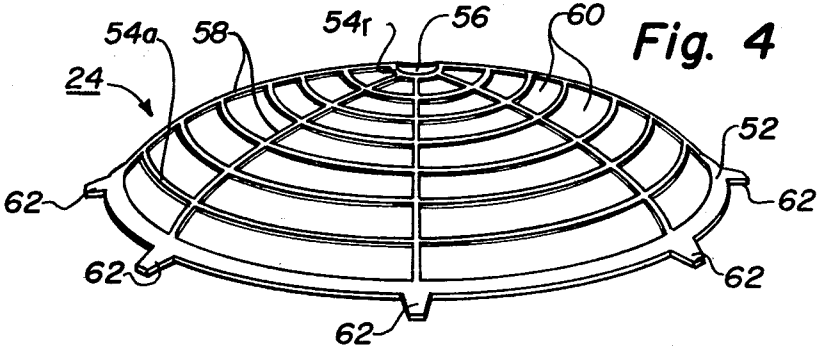
FIG. 4 is a perspective view of the novel mesh structure subsequent to forming into a non-planar mesh structure.
Figure 2:
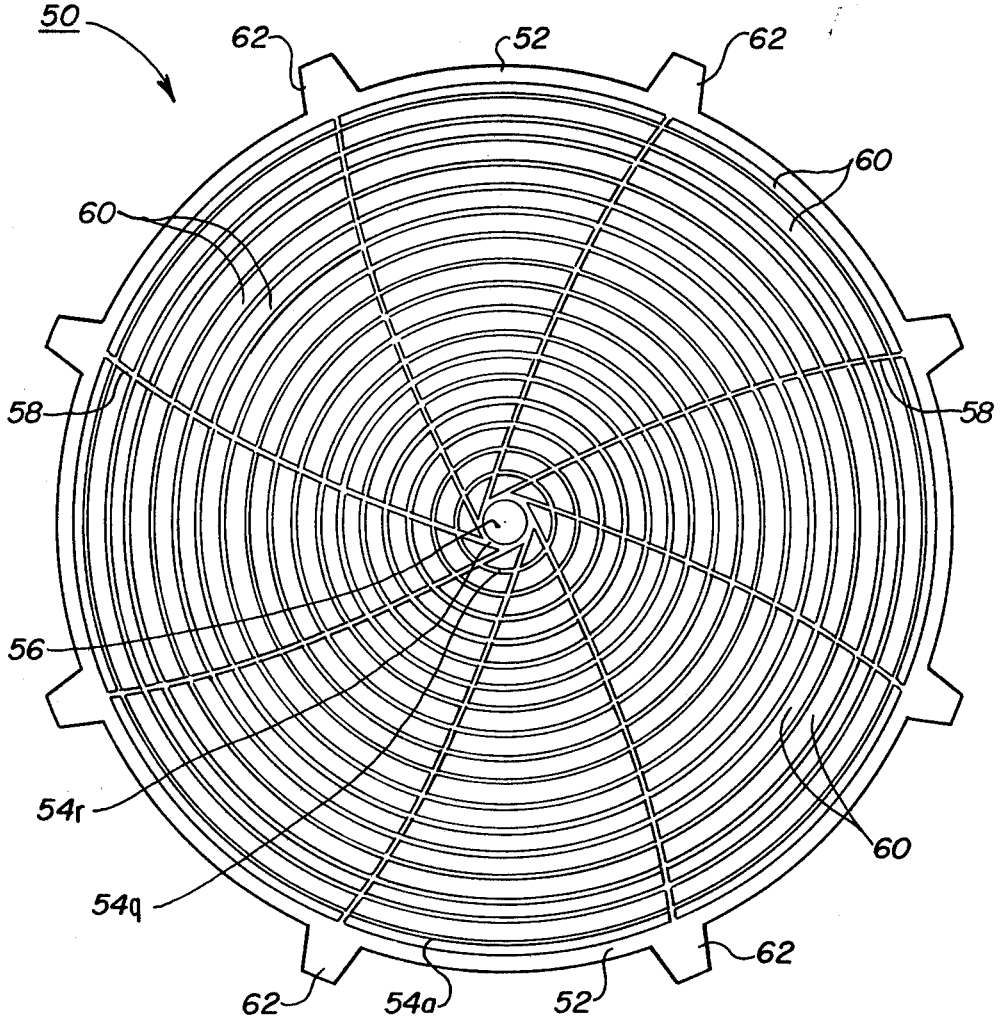
FIG. 2 is a plan view of one embodiment of the novel planar mesh electrode structure prior to forming into a non-planar mesh electrode structure.

With the exception of the non-planar mesh electrode structure 24 shown in FIGS. 1 and 4, the tube 10 is similar to the tube structure disclosed in copending U.S. Pat. No. 4,431,943 filed on Oct. 14, 1981, by Faulkner et al., and in copending allowed U.S. patent application Ser. No. 323,236 filed on Nov. 20, 1981 by Faulkner et al., assigned to the same assignee of the present application and incorporated herein for the purpose of disclosure. The non-planar mesh electrode structure 24 is formed from a planar mesh structure 50 shown in FIG. 2. The planar mesh structure 50 includes a peripheral support ring 52 and a plurality of first members **54*a* through 54*r* comprising substantially concentric mesh rings of progressively decreasing diameter. The innermost first member, 54*r*, circumscribes a central aperture 56. The first members 54*a* through 54*r* are spaced apart to permit photoelectrons from the photocathode 20 to pass between the adjacent rings of the mesh structure. A plurality of second members 58 having a generally arcuate shape extend generally inwardly from the peripheral support ring 52 and terminate at the innermost of the first members 54*r*. To provide a sufficiently strong mesh structure, at least eight equally-spaced second members 58 are provided. The second members 58 intersect the first members 54*a* through 54*q* that are disposed between the peripheral support ring 52 and the innermost of the first members 54*r* to form, with the intersected first members, a plurality of apertures 60. A plurality of mounting tabs 62 are provided around the outer periphery of the support ring 52 to facilitate attaching the electrode structure 24 to the field-forming electrode 22. The novel planar mesh electrode structure 50 is chemically etched from type 304** stainless steel. Chemical etching is well known in the art and the process need not be described.

In the preferred embodiment, the inside radius of curvature of the envelope faceplate 16 is about 48.26 mm and the outside radius of curvature of the non-planar mesh electrode structure 24 is about 45.72 mm. Typically, about 2.54 mm of spacing is provided between the inside surface of the faceplate 16 and the outside surface of the mesh electrode structure 24. In the prior art, a domed mesh electrode such as that described in the above-referenced U.S. Pat. No. 4,060,747 to Faulkner was formed by stretching a planar metal member to achieve a non-planar shape. The stretching operation frequently tore the mesh members, especially the radial members which experienced the greatest amount of elongation. The novel planar mesh electrode structure 50 eliminates the problem of mesh tearing during forming or doming by providing forming relief in the form of the arcuately-shaped second members 58. In the above-described preferred embodiment, the mesh electrode structure has a thickness of about 0.127 mm. Each of the second members 58 has a typical radius of curvature of 45.72 mm and a width of about 0.127 mm. Initially, the second members 58 lie in the plane of the peripheral support ring 52 and the ring-shaped first members **54*a* through 54*r*. The arcuate shape of the second members 58 is sufficiently long to permit the second members to be transformed from the above-described plane to a second plane substantially orthogonal to the aforementioned plane without stretching the second members 58. For a photomultiplier tube having an outside diameter of about 50.8 mm, the peripheral support ring 52 has a outside diameter of about 48.46 mm and an inside diameter of about 46.84 mm with a width of about 0.81 mm. Each of the ring-shaped first members 54*a* through 54*q* has a width of about 0.127 mm while the width of the innermost first member 54*r*** is about 0.3175 mm.

Figure 5:
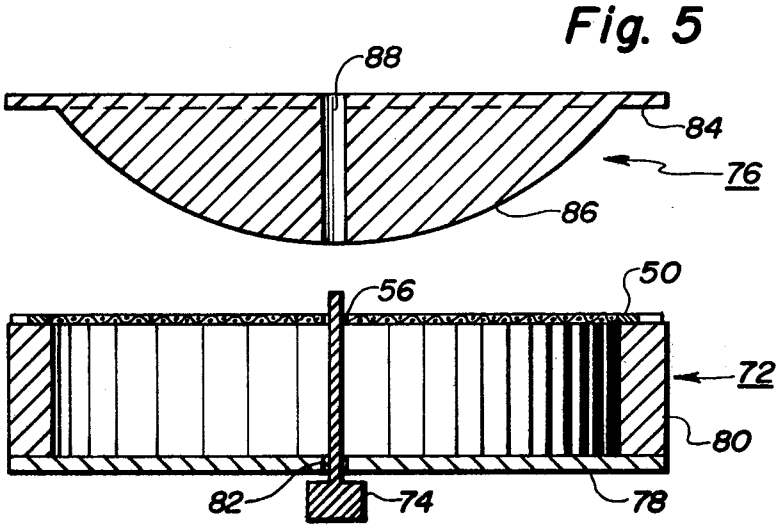
FIG. 5 is a cross-sectional exploded view of the mesh-forming fixture and a planar mesh structure prior to forming.

In order to form the planar mesh electrode structure 50 into the non-planar mesh electrode structure 24 shown in FIGS. 1 and 4, a forming fixture 70 is used. The forming fixture 70 shown in FIG. 5, comprises a base portion 72, a centering pin 74 and a doming portion 76. The base portion 72 comprises a support plate 78 and a support ring 80. A positioning aperture 82 extends through the center of the support plate 78. The planar mesh structure 50 is placed upon the support ring 80. The centering pin 74 is then disposed within the positioning aperture 82 of the support plate 78. The pin 74 extends through the central aperture 56 of the planar mesh structure 50 and accurately locates the planar mesh structure 50 relative to the base portion 72 of the forming fixture 70.

The doming portion 76 of the forming fixture 70 comprises a support shoulder 84 and a forming dome 86.

A locating aperture 88 extends through the center of the forming fixture portion 76. The forming dome 86 has a radius of curvature of about 45.593 mm which, with the 0.127 mm thickness of the mesh structure, provides the desired radius of curvature of about 45.21 mm for outside surface of the non-planar mesh structure 24. The doming portion 76 is placed upon the portion of the centering pin 74 extending through the central aperture 56 of the mesh structure 50 with the forming dome 86 facing the mesh structure 50. As the doming portion 76 is lowered onto the mesh structure 50, the arcuately-shaped second members 58 are displaced from the original plane of the planar mesh structure 50 to a second plane in the non-planar mesh structure 24 that is orthogonal with the original plane. Since the radius of curvature of the formed, i.e., non-planar mesh is about 45.72 mm and the radius of curvature of the arcuately-shaped second members 58 prior to the forming was 45.72 mm, the second members do not undergo a stretching or elongation during the forming process and thus the likelihood of rupturing the novel mesh structure during forming is reduced. While some stress occurs at the intersections of the second members 58 with the peripheral support ring 52 and the first members 54, this stress is not sufficient to rupture the non-planar mesh structure 24. As shown in FIG. 4, the second members 58 of the formed, i.e., the non-planar, mesh electrode structure 24 extend radially inwardly from the peripheral support ring 52 to the innermost of the first members **54*r***.

Figure 3:
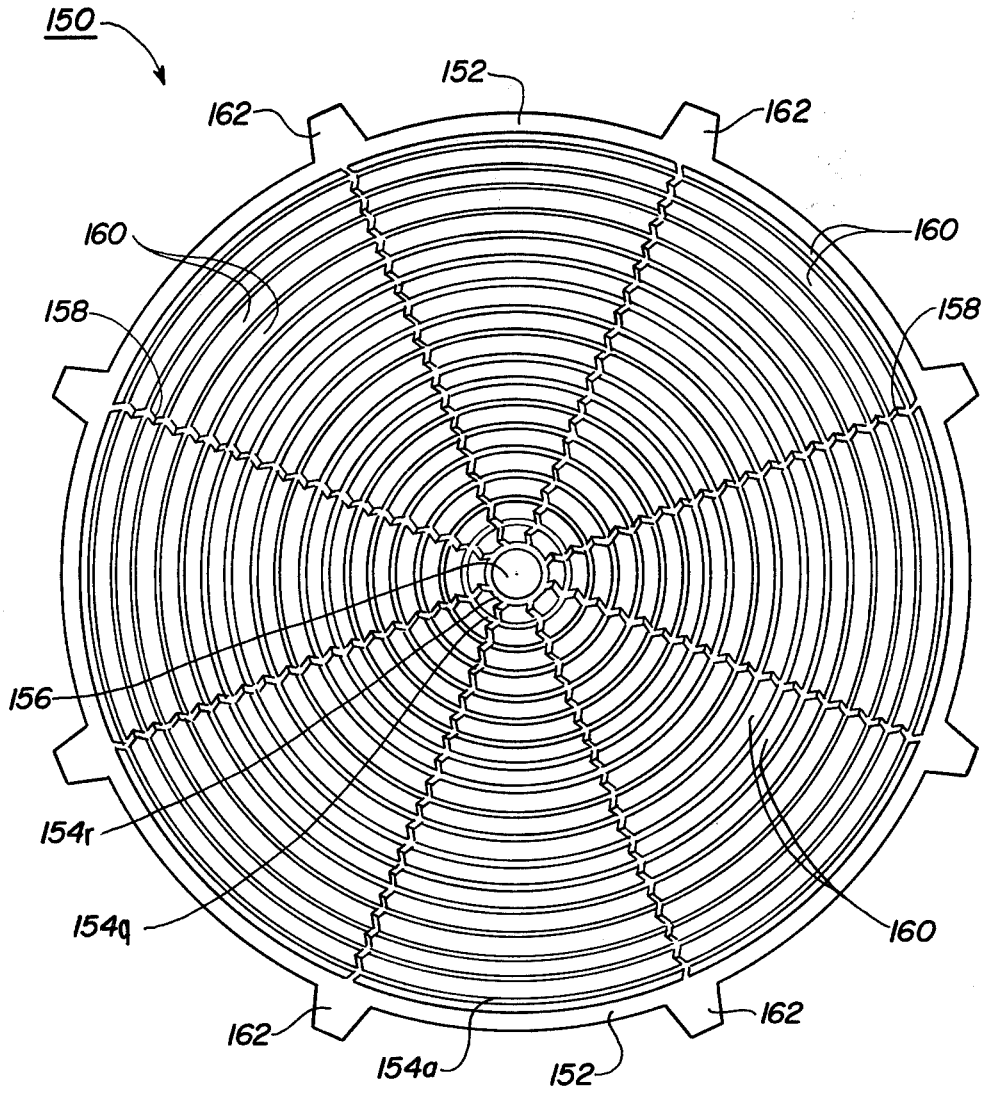
FIG. 3 is a plan view of an alternative embodiment of the novel planar mesh structure prior to forming into a non-planar mesh structure.

An alternative embodiment of a novel planar mesh electrode structure 150 is shown in FIG. 3. The planar mesh structure 150 includes a peripheral support ring 152, a plurality of first members **154*a* through 154*r* comprising concentric rings of progressively decreasing diameter, and a central aperture 156 circumscribed by the innermost of the first members 154*r*. A plurality of second members 158 extend generally inwardly from the peripheral support ring 152 and terminate at the innermost of the first members 154*r*. The second members 158 have a generally undulatory, i.e., a sawtooth or sinusodial, shape that provides the necessary forming relief with the undulations lying in the plane of the mesh structure 150. The width and thickness of the first and second members 154 and 158, respectively, are the same as for the similar members of mesh structure 50. During the forming process described above for the mesh structure 50, the undulations are straightened with a minimal amount of stress on, but no elongation or stretching of, the second members 158 as the planar mesh structure 150 is formed into a non-planar configuration. Preferably, eight second members 158 evenly disposed around the mesh structure 150** should be used to provide a strong mesh structure.

In the non-planar mesh structure 24, the number of first members is eighteen for each of the embodiments described herein. The optical transmission for a mesh structure having eighteen first members and eight second members with the above-described dimensions is typically about 90 percent.

What is claimed is:

1. An electrically conductive planar mesh electrode structure that facilitates forming into a non-planar mesh electrode structure including:

a peripheral support ring lying in a first plane;

a plurality of first members lying in said first plane, said first members comprising substantially concentric, spaced-apart mesh rings of progressively decreasing diameter disposed within said peripheral support ring; and a plurality of second members having a generally arcuate shape lying in said first plane and extending generally inwardly from said peripheral support ring and terminating at the innermost of said first members, said second members intersecting said first members to form, with said intersected first members, a plurality of apertures, said generally arcuate shape of said second members permitting said second members to be formable into a second plane substantially orthogonal to said first plane without significantly stretching said second members.

2. An electrically conductive planar mesh electrode structure that facilitates forming into a non-planar mesh electrode structure including:

a peripheral support ring lying in a first plane;

a plurality of first members lying in said first plane, said first members comprising substantially concentric, spaced-apart mesh rings of progressively decreasing diameter disposed within said peripheral support ring; and a plurality of second members having a generally undulatory shape lying in said first plane and extending generally inwardly from said peripheral support ring and terminating at the innermost of said first members, said second members intersecting said first members to form, with said intersected first members, a plurality of apertures, said generally undulatory shape of said second members permitting said second members to be formable into a second plane substantially orthogonal to said first plane without significantly stretching said second members.

3. The structure as in claims 1 or 2 wherein said plurality of second members comprise at least eight second members equally spaced around said peripheral annular support ring.

4. The structure as in claim 3 including a plurality of mounting tabs extending radially outwardly from said peripheral support ring.

* * * * *